US012454818B2

(12) United States Patent
Ward et al.

(10) Patent No.: US 12,454,818 B2
(45) Date of Patent: Oct. 28, 2025

(54) SYSTEM AND METHOD FOR PLUGGING WASTE DISPOSER AUXILIARY PORT

(71) Applicant: InSinkErator LLC, Mount Pleasant, WI (US)

(72) Inventors: Jeffrey S. Ward, Kenosha, WI (US); Kelly T. Gamble, Waterford, WI (US); Kevin McClory, Pleasant Prairie, WI (US); Dane Hofmeister, Mount Pleasant, WI (US)

(73) Assignee: InSinkErator LLC, Benton Harbor, MI (US)

( * ) Notice: Subject to any disclaimer, the term of this patent is extended or adjusted under 35 U.S.C. 154(b) by 365 days.

(21) Appl. No.: 18/102,244

(22) Filed: Jan. 27, 2023

(65) Prior Publication Data

US 2024/0254747 A1 Aug. 1, 2024

(51) Int. Cl.
*E03C 1/266* (2006.01)
*A47L 15/42* (2006.01)
*E03C 1/184* (2006.01)

(52) U.S. Cl.
CPC ..... *E03C 1/2665* (2013.01); *A47L 15/4223* (2013.01)

(58) Field of Classification Search
CPC ..... E03C 1/2665; E03C 1/184; E03C 1/266; A47L 15/4223; B02C 18/2291
See application file for complete search history.

(56) References Cited

U.S. PATENT DOCUMENTS 2,965,318 A * 12/1960 Jordan ..... E03C 1/2665 241/46.014
3,011,192 A * 12/1961 Delamater ..... E03C 1/2665 15/74

(Continued)

FOREIGN PATENT DOCUMENTS

CN 209873980 U 12/2019
CN 210887466 U 6/2020

(Continued)

OTHER PUBLICATIONS

International Search Report and Written Opinion for International Application No. PCT/US2024/012942 dated May 16, 2024 (36 pages).

(Continued)

*Primary Examiner* — Mohammed S. Alawadi
(74) *Attorney, Agent, or Firm* — Brooks Kushman P.C.

(57) ABSTRACT

Waste disposers, such as food waste disposers, combination systems including such waste disposers, and related methods, are disclosed herein. In one example embodiment, a food waste disposer includes a dishwasher inlet having an inner wall that defines a channel and includes a first protrusion that extends radially inwardly toward a first central axis. Additionally, the food waste disposer includes a plug that includes an exterior surface having first and second barrier wall portions that together at least partly define a curving indentation that extends both substantially axially and also extends circumferentially substantially ninety degrees. The inlet and plug are configured so that, when the plug is supported within the inlet in a fully installed position in which the first protrusion extends into the indentation so as to be in contact with or proximate to an end of the indentation, then the plug is retained axially relative to the inlet.

20 Claims, 7 Drawing Sheets

(56) References Cited

U.S. PATENT DOCUMENTS

| | | | | |
|---|---|---|---|---|
| 3,154,650 | A | 10/1964 | Brucken et al. | |
| 3,163,369 | A * | 12/1964 | Hogue | E03C 1/2665 310/43 |
| 3,181,801 | A | 5/1965 | Lung et al. | |
| 3,181,802 | A | 5/1965 | Lung et al. | |
| 3,464,638 | A | 9/1969 | Enright et al. | |
| 4,135,258 | A | 1/1979 | Braga et al. | |
| 7,905,367 | B2 | 3/2011 | Jessberger | |
| 8,561,761 | B2 | 10/2013 | Jessberger et al. | |
| 8,701,916 | B2 | 4/2014 | Cook et al. | |
| 8,875,933 | B2 | 11/2014 | Griffiths et al. | |
| 11,198,995 | B2 | 12/2021 | Dodd et al. | |
| 11,448,106 | B2 | 9/2022 | Ishigami | |
| 11,454,146 | B2 | 9/2022 | Ito et al. | |
| 2013/0299616 | A1* | 11/2013 | Bewley, Jr. | B02C 18/0092 241/46.016 |
| 2016/0237665 | A1 | 8/2016 | Coll et al. | |
| 2018/0066551 | A1 | 3/2018 | Weber et al. | |
| 2021/0189707 | A1 | 6/2021 | Wright | |
| 2021/0381407 | A1 | 12/2021 | Boden et al. | |

FOREIGN PATENT DOCUMENTS

| | | | |
|---|---|---|---|
| CN | 111997708 | A | 11/2020 |
| DE | 202017103222 | U1 | 10/2018 |
| WO | 201017867 | A1 | 2/2010 |
| WO | 201017867 | A9 | 7/2010 |

OTHER PUBLICATIONS

Moen Product Literature for Garbage Disposal, INS107189C dated Jun. 23, 2022 (16 pages).

* cited by examiner

SYSTEM AND METHOD FOR PLUGGING WASTE DISPOSER AUXILIARY PORT

FIELD

The present disclosure relates to waste disposers such as food waste disposers that have auxiliary ports such as, for example, ports by which the food waste disposers can be in fluid communication with external devices and systems such as dishwashers and, more particularly, to systems and methods for controlling the opening and closing, or plugging, of such auxiliary ports of waste disposers.

BACKGROUND

Food waste disposers are used to comminute food scraps into particles small enough to pass through household drain plumbing. A food waste disposer typically includes a primary inlet along the top of the food waste disposer at which the food waste disposer receives water and food scraps from a sink, and also a primary outlet at which food waste and water are output from the food waste disposer. Additionally, a food waste disposer typically includes a dishwater inlet, often along the side of the food waste disposer. The dishwasher inlet is an auxiliary port of the food waste disposer, in addition to the primary inlet and primary outlet, at which water output by a dishwasher (often situated near the food waste disposer) can be directed into the food waste disposer. Typically a dishwasher is coupled to the dishwasher inlet by a hose, tube, or pipe.

Although food waste disposers typically include dishwasher inlets, such food waste disposers are not always, and need not be, coupled to dishwashers when those food waste disposers are implemented. Indeed, in some homes or other environments in which food waste disposers are installed, there are no dishwashers that are present, or any dishwashers that are present are too far from the food waste disposers for it to be practical to couple the dishwashers to the food waste disposer (or, in some case, the dishwashers may be coupled to discharge water via a different route than via any food waste disposers). When implemented in such circumstances, it is necessary or desirable for the dishwasher inlet of a food waste disposer to be closed or sealed, so that the food waste and associated water that may be present within the food waste disposer during operation will only exit the food waste disposer via the primary outlet and not exit or leak out of the food waste disposer by way of the dishwasher inlet.

Although it is necessary or desirable for dishwasher inlets to be closed or sealed in such circumstances, challenges exist with existing method for closing or sealing such dishwasher inlets. More particularly, although there do exist plugs that can be inserted into the dishwasher inlets to close or seal the dishwasher inlets when appropriate, conventional plugs are often difficult to remove or install with respect to the dishwasher inlets. In some cases conventional plugs may break when being removed from dishwasher inlets such that it becomes difficult, or is no longer possible, to reinstall or reuse those plugs. Also, in some cases, it may be necessary to for users/installers to apply undesirably high levels of force when installing conventional plugs relative to dishwasher inlets so as to achieve successful installation.

For at least one or more of these reasons, or one or more other reasons, it would therefore be advantageous if improved waste disposers (or improved systems employing waste disposers) having improved systems or features for closing, sealing, or plugging auxiliary ports of the waste disposers (such as dishwasher inlets of food waste disposers), and improved methods of operation of such systems, could be developed, so as to address any one or more of the concerns discussed above or to address one or more other concerns or provide one or more benefits.

BRIEF SUMMARY

In at least some example embodiments, the present disclosure relates to a food waste disposer. The food waste disposer includes a food conveying section, a motor section, and a grinding section between the food conveying section and the motor section, and a housing in which are positioned each of the food conveying section, the motor section, and the grinding section, and which additionally includes a dishwasher inlet. The dishwasher inlet includes an inner wall that is substantially cylindrical and that defines a channel extending from a first location along an exterior of the housing and a second location along an interior of the housing, wherein the inner wall includes a first protrusion that extends radially inwardly toward a first central axis of the channel. Additionally, the food waste disposer includes a plug with a first end and a second end, where the plug is substantially cylindrical in shape, and includes an exterior surface having a first barrier wall portion and a second barrier wall portion that together at least partly define a first curving indentation. The first curving indentation extends both substantially axially from the second end toward the first end and also extends circumferentially substantially ninety degrees between the second end and a first internal end of the first curving indentation. Also, the dishwasher inlet and plug are configured so that, when the plug is supported within the dishwasher inlet in a fully installed position in which the first protrusion extends into the first curving indentation so as to be in contact with or proximate to the first internal end, then the plug is retained axially relative to the dishwasher inlet along the first central axis at least in part by contact between the first protrusion and one or both of the barrier wall portions.

Also, in at least some example embodiments, the present disclosure relates to a waste disposer. The waste disposer includes a housing including an inlet port, an outlet port, and an additional port. The additional port includes an inner wall that is substantially cylindrical and that defines a channel extending from a first location along an exterior of the housing and a second location along an interior of the housing, where the inner wall includes a first protrusion that extends radially inwardly toward a first central axis of the channel. The waste disposer also includes a plug with a first end and a second end, where the plug is substantially cylindrical in shape, and includes an exterior surface having a first barrier wall portion and a second barrier wall portion that together at least partly define a first curving indentation. The first curving indentation extends both substantially axially from the second end toward the first end and also extends circumferentially substantially ninety degrees between the second end and a first internal end of the first curving indentation, and the plug further includes a spring extension including a tip portion. Further, the additional port and plug are configured so that, when the plug is supported within the additional port in a fully installed position in which the first protrusion extends into the first curving indentation so as to be in contact with or proximate to the first internal end, then the plug is retained axially relative to the additional port along the first central axis at least in part by contact between the first protrusion and one or both of the barrier wall portions. Also, the additional port includes a block portion extending radially inwardly from a remainder of the inner wall, where the tip portion engages the block portion when the plug is supported within the additional port in the fully installed position so that there is resistance to the plug being rotated in a first rotational direction.

Additionally, in at least some further example embodiments, the present disclosure relates to a method of operating a dishwasher inlet of a food waste disposer having a food conveying section, a motor section, and a grinding section between the food conveying section and the motor section and a housing in which are positioned each of the food conveying section, the motor section, and the grinding section. The method includes providing a plug with a first end and a second end, where the plug is substantially cylindrical in shape, and includes an exterior surface having a first barrier wall portion and a second barrier wall portion that together at least partly define a first curving indentation, where the first curving indentation extends both substantially axially from the second end toward the first end and also extends circumferentially substantially ninety degrees between the second end and a first internal end of the first curving indentation. The method also includes inserting the plug into a channel defined by a substantially cylindrical inner wall of the dishwasher inlet, where the inner wall includes a first protrusion extending radially inwardly toward a first central axis of the channel, and where the plug is inserted substantially axially along the first central axis of the channel so that the second end of the plug proceeds from a first location along an exterior of the housing toward a second location along an interior of the housing. Additionally, the method includes rotating the plug by substantially ninety degrees in a first rotational direction as the plug is further inserted into the channel, the rotating occurring at least in part because the first protrusion of the inner wall proceeds into and through the first curving indentation until the first protrusion contacts or becomes proximate to the first internal end as the plug is further inserted into the channel, whereby the plug attains a fully installed position relative to the dishwasher inlet in which the plug is retained axially relative to the dishwasher inlet along the first central axis at least in part by contact between the first protrusion and one or both of the barrier wall portions.

BRIEF DESCRIPTION OF THE DRAWINGS

Embodiments of waste disposers such as food waste disposers (or systems including waste disposers), systems or devices for plugging, closing, or sealing auxiliary ports such as dishwasher inlets for such waste disposers, and/or related methods, are disclosed with reference to the accompanying drawings and are for illustrative purposes only. The systems and methods encompassed herein are not limited in their applications to the details of construction, arrangements of components, or other aspects or features illustrated in the drawings, but rather such systems and methods encompassed herein include other embodiments or are capable of being practiced or carried out in other various ways. Like reference numerals are used to indicate like components. In the drawings.

DETAILED DESCRIPTION

Figure 1:
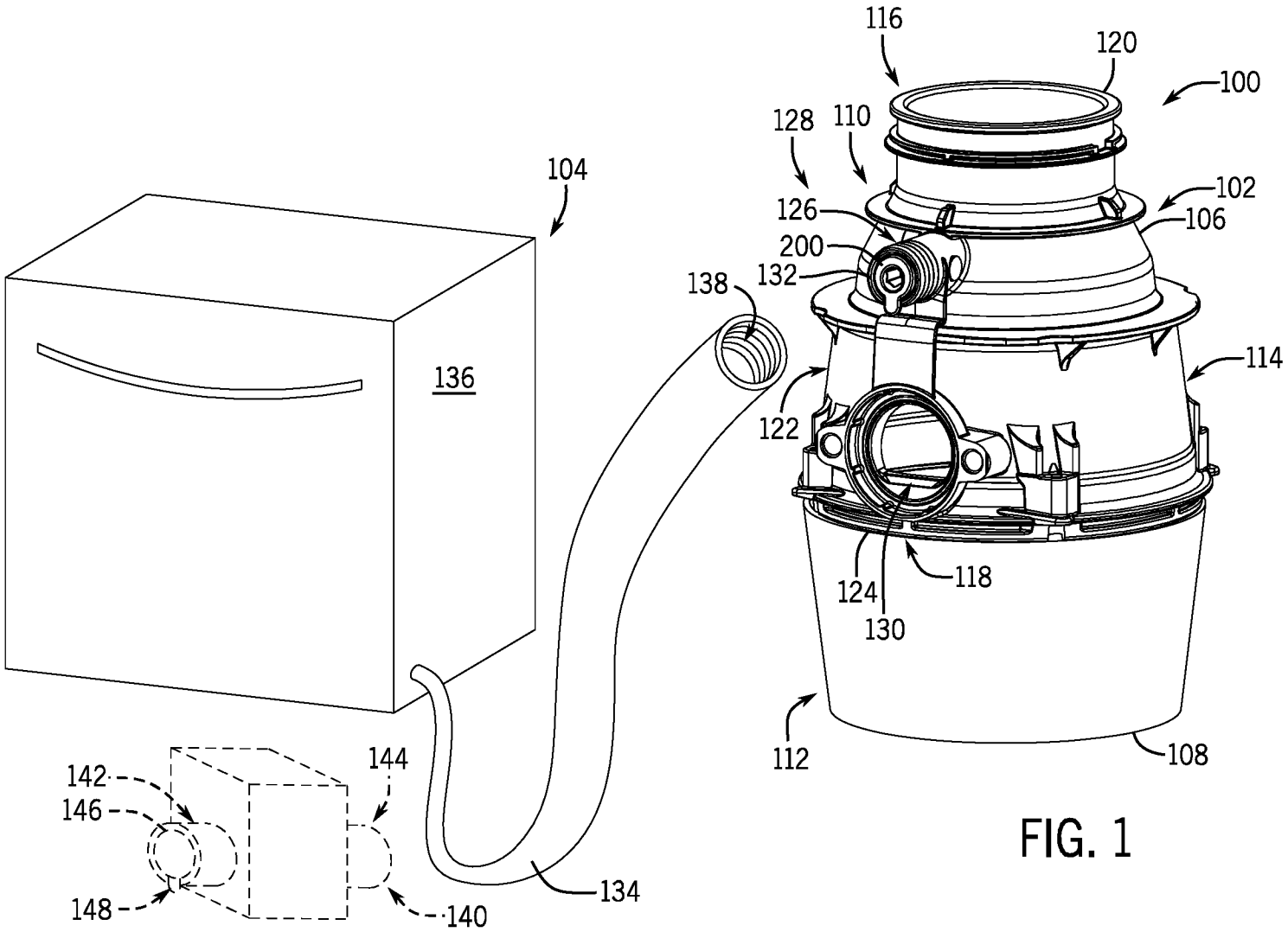
FIG. 1 is a substantially front perspective, partially-schematic view of a combination system including a food waste disposer and a dishwasher (and optionally also including an auxiliary device), in which a hose for coupling the dishwasher (at least indirectly) with the food waste disposer is disconnected from a dishwasher inlet of the food waste disposer, and in which the dishwasher inlet is shown to be closed/sealed by a plug, in accordance with a first example embodiment encompassed herein.

Referring to FIG. 1, a substantially front perspective, partially-schematic view of a combination system 100 including a food waste disposer 102 and a dishwasher 104 is shown. The food waste disposer 102 includes a top housing portion (or enclosure) 106 and a bottom housing portion 108. Also, the food waste disposer 102 can be understood as including a food conveying section 110, a motor section 112, and a grinding section 114. The food conveying section 110 is generally positioned at a region at or near the top of the food waste disposer 102, within the enclosure 106, and the motor section 112 is generally positioned at a location corresponding to, and within, the bottom housing portion 108. The grinding section 114 is disposed, within the housing (e.g., within the enclosure 106 as illustrated) between the food conveying section 110 and the motor section 112. It will be appreciated that motor section 112 includes a motor (not shown), such as an inductive motor or permanent magnet motor, which operates to impart rotational movement to a motor shaft to operate the grinding section 114.

Further as shown, the food waste disposer 102 includes a primary input port or inlet 116 and a primary output port or outlet 118. The primary inlet 116 is positioned along or proximate to a top end 120 of the food waste disposer 102, and is configured to receive water and food scraps from a sink (not shown) to which the food waste disposer is mounted during operation of the food waste disposer. The primary outlet 118 is formed along a first sidewall portion 122 of the enclosure 106, proximate a junction 124 between the enclosure 106 and the bottom housing portion 108, and is configured to allow for food waste and water to pass from the grinding section 114 out from the food waste disposer 102 during operation. Additionally as shown, the food waste disposer 102 also includes a dishwasher inlet 126 that is an auxiliary port of the food waste disposer and that also is formed along, and as part of, the first sidewall portion 122. In the present example embodiment, the dishwasher inlet 126 is positioned approximately midway between the top end 120 and the primary outlet 118, at a location generally above the grinding section 114, and is angularly/circumferentially aligned with the primary outlet (in terms of circumferential positioning about a vertical central axis of the food waste disposer 102). In alternate embodiments, the exact positioning of the dishwasher inlet 126 relative to other portions of the food waste disposer can vary from that shown.

For purposes of the present discussion, the dishwasher inlet 126 can be understood to refer to the structure that defines a channel 300 (see FIG. 3) leading between a region 128 outside of the food waste disposer and an interior region 130 within the food waste disposer (as is partly visible by way of the primary outlet 118 as illustrated in FIG. 1). In the present example, the dishwasher inlet 126 includes a cylindrical structure 132 that extends radially outward from the first sidewall portion 122, as well as a portion of the first sidewall portion itself from which that cylindrical structure extends.

The dishwasher inlet 126 serves as an auxiliary port of the food waste disposer 102 at which water output by the dishwasher 104 can be directed into the food waste disposer if the dishwasher is coupled to the dishwasher inlet. As shown in FIG. 1, in the present embodiment the dishwasher 104 includes a hose 134 (or other tube, connector, or link) that extends outward from a sidewall 136 of the dishwasher to a distal end 138. The distal end 138 can be coupled to the dishwasher inlet 126 in various manners, depending upon the embodiment. For example, in the present embodiment, the cylindrical structure 132 of the dishwasher inlet 126 includes barbs by which the distal end 138 of the hose 134 can be coupled to the dishwasher inlet. Also for example, in an alternate embodiment, the cylindrical structure 132 can include external threads, and the distal end 138 can include complementary internal threads, such that the distal end can be coupled to the cylindrical structure by screwing the distal end onto and in relation to the cylindrical structure.

Although the dishwasher 104 can be coupled to the dishwasher inlet 126 by the hose 134, it will be appreciated that FIG. 1 shows the combination system 100 having a disconnected (rather than connected) status in which the distal end 138 of the hose 134, and thus the dishwasher 104 overall, is not coupled to the dishwasher inlet 126. Further, in the circumstance shown in FIG. 1, not only is the dishwasher 104 decoupled from the dishwasher inlet 126, but also the dishwasher inlet is shown to be sealed or closed off by a plug 200 that is inserted within the channel 300. Further in this regard, FIG. 2 provides an enlarged cutaway view of a portion 202 of the food waste disposer 102 shown in FIG. 1, which particularly shows the dishwasher inlet 126 and the plug 200 fully installed within the dishwasher inlet.

Figure 2:
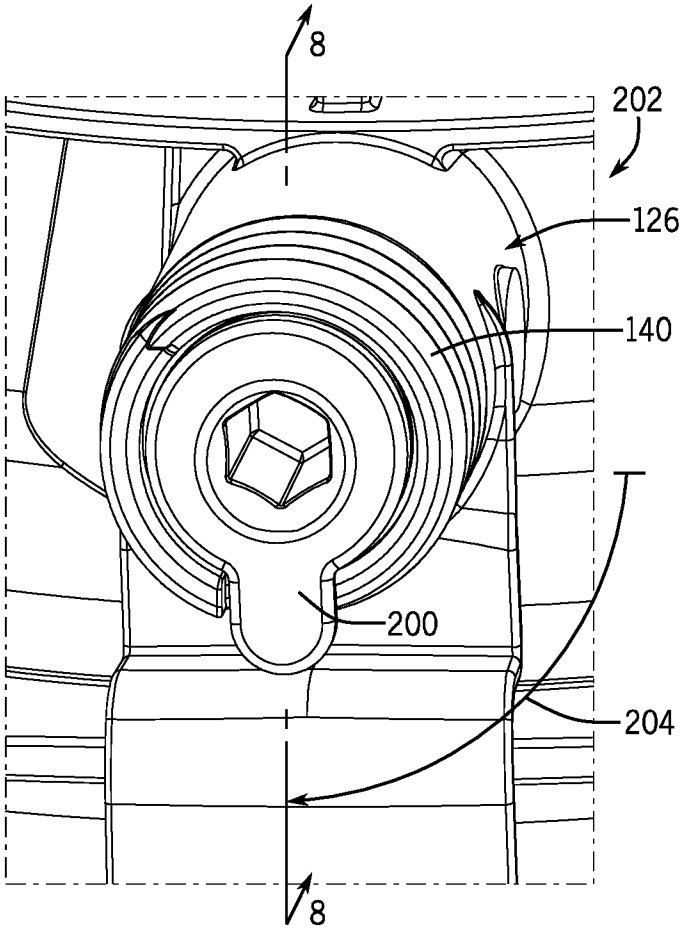
FIG. 2 is an enlarged cutaway view of a portion of the food waste disposer shown in FIG. 1, which particularly shows the dishwasher inlet and the plug.

FIG. 2 additionally includes an arrow 204 illustrating a direction, and approximate extent, of rotation followed by the plug 200 when it is inserted and coupled relative to the dishwasher inlet 126 so as to attain the fully installed position relative to the dishwasher inlet as shown. Further, removal of the plug 200 from the dishwasher inlet 126 when the plug is in the fully installed position of FIG. 2 is accomplished by rotation, to the extent represented by the arrow 204, in a direction opposite to that indicated by the arrow 204.

In the present example of FIG. 2, the arrow 204 is shown to be pointing in a clockwise direction, and so installation is achieved by rotation in the clockwise direction, and removal (deinstallation) is achieved by rotation in the counter-clockwise direction. However, in other embodiments, these directions of rotation of the plug 200 relative to the dishwasher inlet 126 for achieving installation and removal can be the opposite of that shown in FIG. 2. Also, in the present example of FIG. 2, the extent (or magnitude) of rotation that is performed, either in the direction of the arrow 204 to achieve full installation or opposite the direction of the arrow to achieve removal, is ninety (90) degrees, or substantially or approximately ninety degrees. That is, to achieve full installation or removal, respectively, of the plug 200 relative to the dishwasher inlet 126, an operator causes the plug 200 to be rotated relative to the dishwasher inlet by a quarter-turn, or substantially or approximately a quarter turn, in the direction of the arrow 204 or in the direction opposite to that of the arrow 204, respectively. However, in alternate embodiments, full installation or removal can be achieved by greater or lesser amounts of rotation of the plug relative to the dishwasher inlet.

Figure 3:
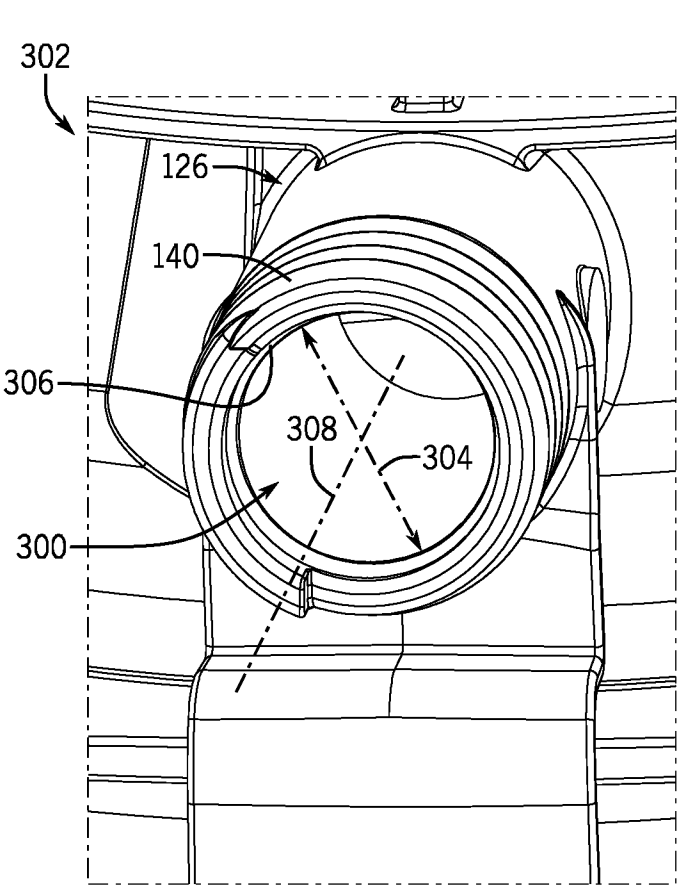
FIG. 3 provides the same enlarged cutaway view of the food waste disposer that is shown in FIG. 2 with the plug no longer being present.

In contrast to FIG. 2 (and FIG. 1), FIG. 3 provides an additional enlarged cutaway view of a portion 302 of the food waste disposer 102 shown in FIG. 1 that is identical to the portion 202 of FIG. 2 except insofar as FIG. 3 shows the dishwasher inlet 126 with the plug 200 removed or absent, such that the channel 300 within the dishwasher inlet is not plugged, blocked, closed, or sealed. Given this unplugged or open status of the dishwasher inlet 126, the channel 300 is visible in FIG. 3. As discussed in further detail below, although the channel 300 is substantially cylindrical and has a diameter 304 that is substantially consistent along the length of the channel 300, there are multiple features provided along an inner wall 306 of the dishwasher inlet 126 forming the channel 300 such that the channel is not fully cylindrical and does not have the diameter 304 consistently along its length along a central axis 308, or at all angular directions about (perpendicular to) the central axis.

It will be appreciated that, when the plug 200 is fully installed within the dishwasher inlet 126 as shown in FIG. 2, the dishwasher inlet has a plugged or closed (or sealed) status such that the flow of fluids/material out of, or into, the food waste disposer 102 via the channel 300 of the dishwasher inlet 126 is precluded by the plug. However, when the dishwasher inlet 126 has the unplugged or open status as shown in FIG. 3, fluid/material can flow out of, or into, the food waste disposer 102 by way of the dishwasher inlet and particularly the channel 300 therewithin. It is when the dishwasher inlet 126 has this open status (not plugged, blocked, closed, or sealed by way of the plug 200) that the dishwasher inlet 126 particularly can be coupled to the dishwasher 104 by the hose 134. Additionally, when so coupled, the dishwasher inlet 126 can receive water discharged from the dishwasher 104 via the hose 134 and communicate that water into the interior region 130 of the food waste disposer 102.

Figure 4:
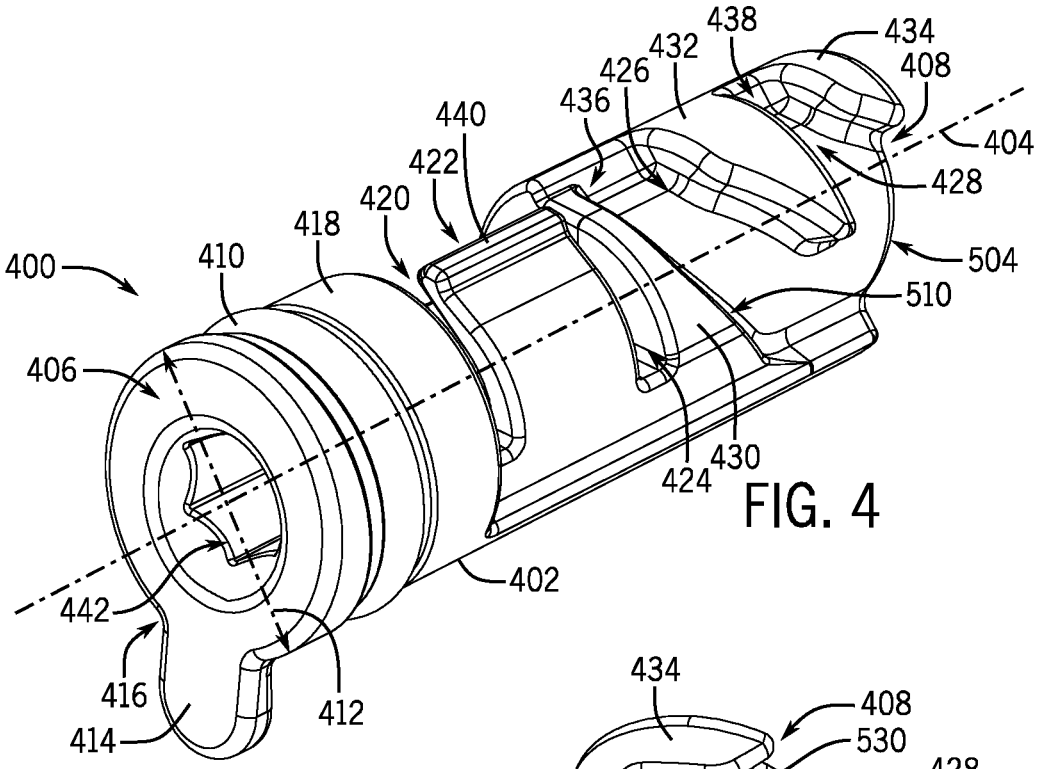
FIGS. 4 and 5 respectively show first and second perspective views, respectively, of the plug of FIGS. 1 and 2.
Figure 5:
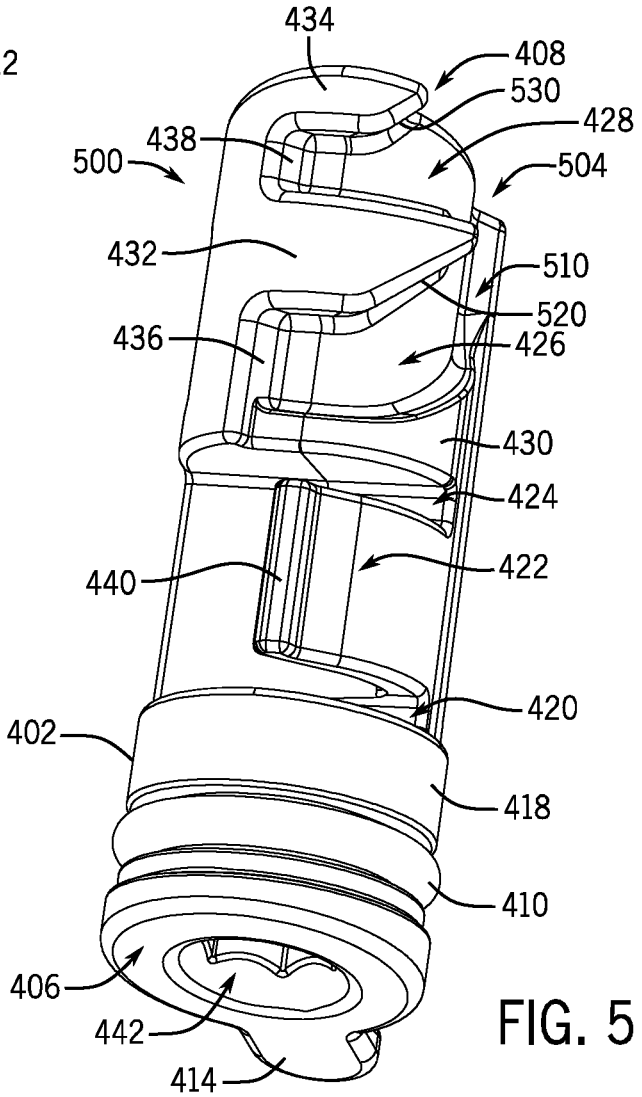

Turning to FIG. 4 and FIG. 5, respectively, a first perspective view 400 and a second perspective view 500, respectively, of the plug 200 are provided to show in more detail the shape of the plug and several features of the plug. The first perspective view 400 is a substantially a front (and right side) perspective view and the second perspective view 500 is substantially a top perspective view. As shown, the plug 200 has a main body 402 that is a substantially cylindrical structure extending along a central axis 404 (see FIG. 4) from a front end 406 to a rear end 408, and also includes an O-ring 410 supported upon and extending around the main body, which is positioned between the front end and rear end at a location adjacent to the front end.

Generally, at many locations along its length, the main body 402 of the plug 200 has a diameter that equals or substantially equals a front end diameter 412 shown in FIG. 4. Nevertheless, the main body 402 of the plug 200 does not have a constant diameter at all locations, but rather can vary depending upon the position along the length of the central axis 404 as well as upon the angle about the central axis at which the diameter is measured. For example, despite having the front end diameter 412 when viewed at most angles about the central axis 404 at the front end 406, the main body 402 at the front end does include an outwardly-extending tab 414 that juts radially outward from a first side circumferential location 416 of the front end. Additionally as shown in FIGS. 4 and 5, as one proceeds down the length of the plug 200 from the front end 406 to the rear end 408 (e.g., along/parallel to the central axis 404), the plug also includes the O-ring 410, which has an outer diameter that is slightly larger than the front end diameter 412 when the O-ring is not under compression (as shown).

Further, as one proceeds down the length of the plug 200 beyond the O-ring 410, there is provided an intermediate annular region 418 having the same or substantially the same diameter as the front end diameter 412 and that is approximately twice the axial width of the O-ring. Subsequently, as one proceeds past the intermediate annular region 418 there is a first gap 420 followed by a locking spring extension 422 and then a second gap 424. The locking spring extension 422, which is described in further detail with respect to FIGS. 8, 9, and 10, when not under compression, generally has an outer circumference that is radially inward by comparison by comparison with the outer circumference of the intermediate annular region 418 and the front end 406 (excepting the outwardly-extending tab 414). The locking spring extension 422 also includes a tip portion 440 that protrudes substantially radially outward away from the central axis 404 so as to extend further radially outward from the central axis than the remainder of the locking spring extension.

Additionally, as one proceeds further down the length of the plug 200 beyond the second gap 424, the main body 402 includes first and second curving indentations 426 and 428, respectively. The first curving indentation 426 extends from the rear end 408 toward the front end 406 up to a first barrier wall 430 separating the first curving indentation from the second gap 424. Additionally, as the first curving indentation 426 extends from the rear end 408 toward the front end 406, the first curving indentation generally also extends circumferentially in a helical manner about the central axis 404, approximately 90 degrees. The second curving indentation 428 also extends from the rear end 408 toward the front end 406 up to a second barrier wall 432 separating the first curving indentation 426 from the second curving indentation. Again, as the second curving indentation 428 extends from the rear end 408 toward the front end 406, the second curving indentation generally also extends circumferentially in a helical manner about the central axis 404, about 90 degrees. As the second curving indentation extends circumferentially as it proceeds away from the rear end 408, the indentation eventually becomes separated from the rear end 408 by a third barrier wall 434.

It will be appreciated that the first, second, and third barrier walls 430, 432, and 434 have surfaces that define or substantially define the outlines and curving shapes of the first and second curving indentations 426 and 428. Also, the first and second barrier walls 430 and 432 are connected with one another to form a first end wall portion 436 defining an internal end of the first curving indentation 426, and the second and third barrier walls 432 and 434 are connected with one another to form a second end wall portion 438 defining an internal end of the second curving indentation, where those first and second end wall portions of the first and second curving indentations are circumferentially aligned and are nearly diametrically opposed to the radial direction in which the outwardly-extending tab 414 extends from the front end 406.

In the present embodiment, each of the first and second curving indentations 426 and 428 curves circumferentially in a counterclockwise manner as those indentations proceed from the rear end 408 toward the front end 406, assuming that the plug 200 is viewed from the front end (e.g., each indentations curves opposite the direction of the arrow 204 as shown in FIG. 2). Nevertheless, in other embodiments (e.g., ones in which the dishwasher inlet 126 has different features than those as described in regard to FIG. 7), the first and second curving indentations can curve circumferentially in a clockwise manner. Also, in other embodiments, more (or less) than two curving indentations are provided on the plug. Further, in the present embodiment, the plug 200 includes a hex key orifice 442 formed within the center of the front end 406, by which a hex wrench can be used to rotate the plug relative to the dishwasher inlet 126 when the plug is inserted into the dishwasher inlet 126.

Figure 6:
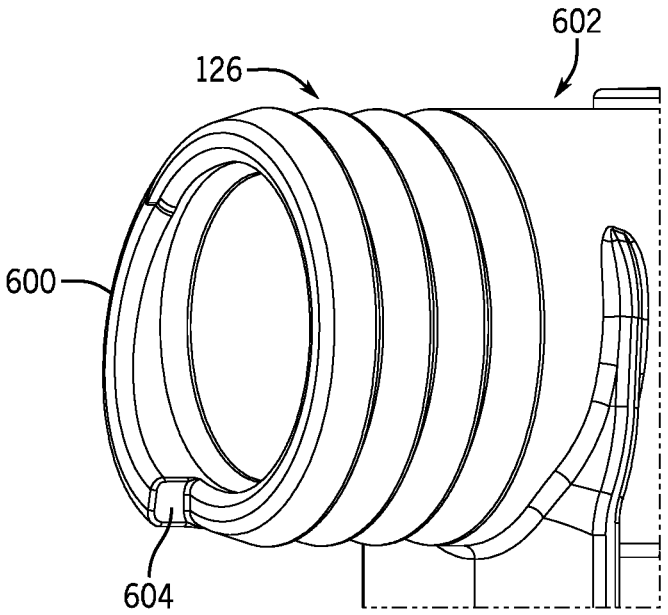
FIGS. 6 and 7 respectively show additional perspective, cutaway views of portions of the food waste disposer of FIG. 1, which again show the dishwasher inlet (or part of the dishwasher inlet) with the plug not being present, and which particularly show interfacing features of the dishwasher inlet of the food waste disposer that are configured to interact with additional features of the plug.
Figure 7:
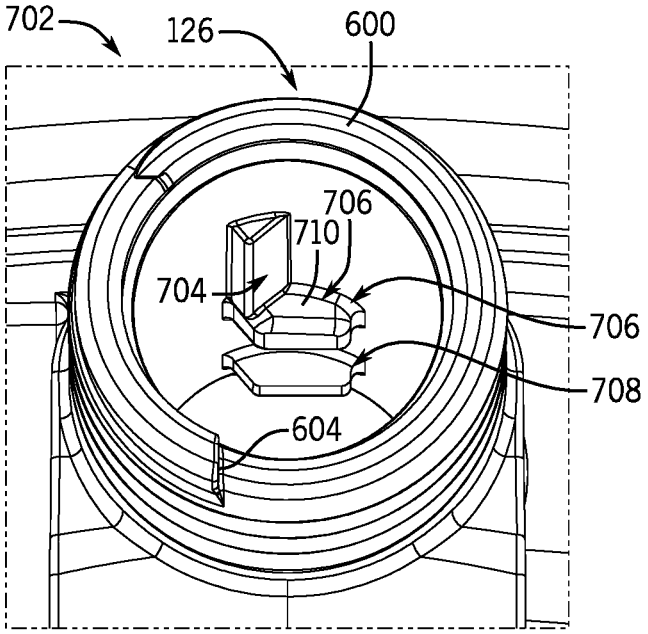

Turning to FIGS. 6 and 7, the dishwasher inlet 126 includes several features that serve to interface some of the above-described features of the plug 200 during installation, and that thereby govern how the plug 200 can be installed within and secured to the dishwasher inlet so as form a tight seal. In particular, FIG. 6 provides a substantially side (right side) perspective, cutaway view of a portion 602 of the food waste disposer 102 including a portion of the dishwasher inlet 126 that particularly includes an outer tip edge 600 of the dishwasher inlet. As shown, the outer tip edge 600 is generally annular but slightly helical such that there is a discontinuity in the form of a rib 604 along the outer tip edge. The rib 604 forms a stop against which the outwardly-extending tab 414 rests when the plug 200 is fully-inserted into the dishwasher inlet 126 as shown in FIG. 2.

Further, FIG. 7 provides an additional substantially front perspective, cutaway view of a portion 702 of the food waste disposer 102 again including a portion of the dishwasher inlet 126, which particularly allows for certain portions of the inner wall 306 defining the channel 300 to be visible. Again, FIG. 7 shows the rib 604 formed along the outer tip edge 600. Additionally, FIG. 7 shows that internal protrusions 700 are formed along the inner wall 306 within the dishwasher inlet 126. More particularly, the inner wall 306 includes, as one proceeds from the outer tip edge 600 along the channel 300 toward the first sidewall portion 122 and the interior region 130 of the food waste disposer 102, a locking block 704, followed by a first internal involute installation lug 706, and then also followed by a second internal involute installation lug 708, all of which are substantially diametrically opposed to the location of the rib 604. Each of the first internal involute installation lug 706 and second internal involute installation lug 708 is a respective protrusion that respectively extends radially inwardly (e.g., from the other surrounding portions of the inner wall 306) toward the central axis 308. Although in the present example embodiment, the first internal involute installation lug 706 and second internal involute installation lug 708 respectively have the respective sizes and respective shapes illustrated in FIG. 7 (and also FIG. 9 and FIG. 10 discussed below), in other embodiments encompassed herein these lugs can respectively have different sizes and/or different shapes.

Figure 8:
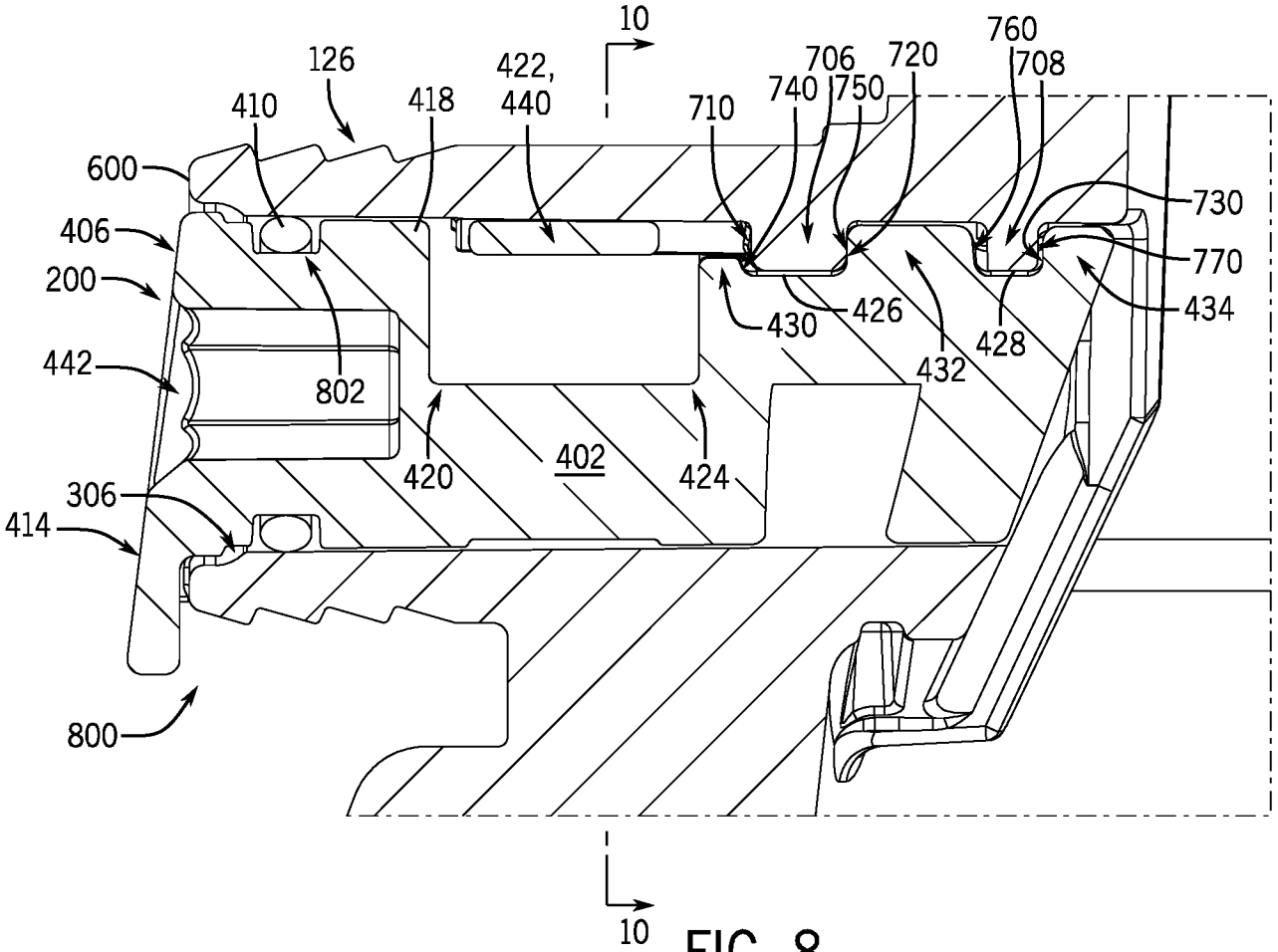
FIG. 8 is a cross-sectional view of the plug and the dishwasher inlet when the plug is fully installed in relation to the dishwasher inlet, taken along a line 8-8 of FIG. 2.
Figure 10:
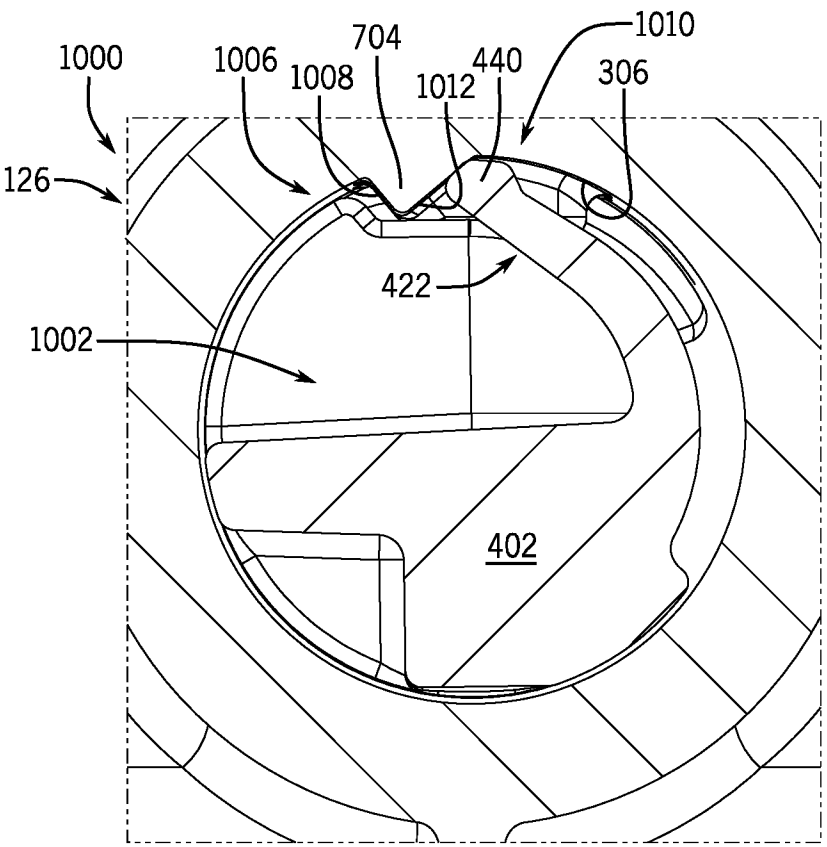
FIG. 10 is a cutaway, cross-sectional view of the dishwasher inlet and the plug installed relative thereto, taken a long a line 10-10 of FIG. 8.
Figure 9:
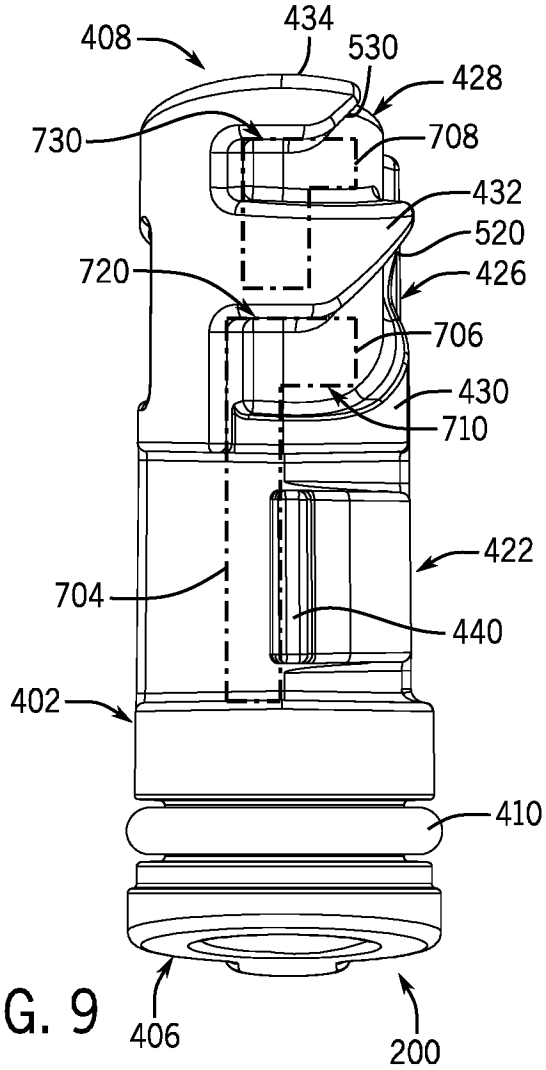
FIG. 9 is a top plan view of the plug of FIGS. 4 and 5 that additionally includes phantom lines illustrating how certain ones of the interfacing features of the dishwasher inlet are positioned relative to the plug when the plug is fully installed in the dishwasher inlet.

Turning to FIG. 8, FIG. 9, and FIG. 10, several views are provided to further show how the features of the plug 200 and features of the dishwasher inlet 126 interface one another during installation of the plug relative to the dishwasher inlet so as to couple the plug to the dishwasher inlet and form a tight seal. FIG. 8 particularly shows a cross-sectional view 800 of the plug 200 and the dishwasher inlet 126 when the plug is fully installed in relation to the dishwasher inlet, taken along a line 8-8 of FIG. 2. FIG. 9 further provides a top plan view of the plug 200 along with phantom lines 900 illustrating how certain ones of the interfacing features of the dishwasher inlet 126 are positioned relative to the plug when the plug is fully installed in the dishwasher inlet. More particularly, as is evident from FIG. 8, when the plug 200 is fully installed in relation to the dishwasher inlet 126, the first internal involute installation lug 706 of the dishwasher inlet 126 extends into the first curving indentation 426 and the second internal involute installation lug 708 of the dishwasher inlet extends into the second curving indentation 428. FIG. 9 additionally shows the first and second involute installation lugs 706 and 708, respectively, to be positioned within the first and second curving indentations 426 and 428, respectively, when the plug 200 is fully installed relative to the dishwasher inlet 126.

Given the relative positioning of first and second internal involute installation lugs 706 and 708 within the first and second curving indentations 426 and 428, the first internal involute installation lug 706 is interlocked between the first barrier wall 430 and second barrier wall 432 and the second internal involute installation lug 708 is interlocked between the second barrier wall 432 and the third barrier wall 434. Further, due to the interlocking of the lugs 706 and 708 and the barrier walls 430, 432, and 434, the plug 200 is precluded from axially moving relative to the dishwasher inlet 126. Thus, when in this position, the plug 200 is precluded from being removed from the dishwasher inlet 126.

Additionally with reference to FIG. 8, the O-ring 410 is shown to be supported upon the main body 402 of the plug 200 and more particularly shown to be supported within an annular notch 802 formed within the main body of the plug 200, which serves to retain the O-ring 410 relative to the main body. Additionally, the O-ring 410 is further shown to be in contact with, and compressed radially inwardly by, the inner wall 306 of the dishwasher inlet. By virtue of this positioning of the O-ring 410 and the contact between the O-ring 410 and each of the main body 402 and the inner wall 306, a seal is formed between the plug 200 and the dishwasher inlet 126. The seal achieved by the O-ring 410, along with additional sealing provided by contact between (or close proximity of) other portions of the surfaces of the main body 402 and adjacent (or proximate) other portions of the inner wall 306, enables the plug 200 to fully plug, seal, or close the dishwasher inlet 126 when the plug 200 is in the fully installed position as represented by FIG. 8 and FIG. 9 (as well as FIG. 2 and FIG. 1), so that the dishwasher inlet has the plugged or closed (or sealed) status.

Further with reference to FIG. 10, an additional cross-sectional view 1000 taken along a line 10-10 of FIG. 8 particularly shows the locking spring extension 422 in relation to the dishwasher inlet 126 when the plug 200 is in the fully installed position as represented by FIG. 8 and FIG. 9 (as well as FIG. 2 and FIG. 1). As shown, the locking spring extension 422 takes the form of a curved flap that overhangs (in the view shown) an approximately-semicylindrical cutout 1002 from the main body 402. Further as shown both in FIG. 10 and FIG. 9, when the plug 200 is in the fully installed position, the tip portion 440 is positioned clockwise (when viewed as shown in FIG. 10, which corresponds to a direction of view proceeding from the front end 406 toward the rear end 408) of the locking block 704. The positioning of the tip portion 440 of the locking spring extension against the locking block 704 tends to counteract any rotational movement of the plug 200 in a counterclockwise direction as represented by an arrow 1004.

Figure 11:
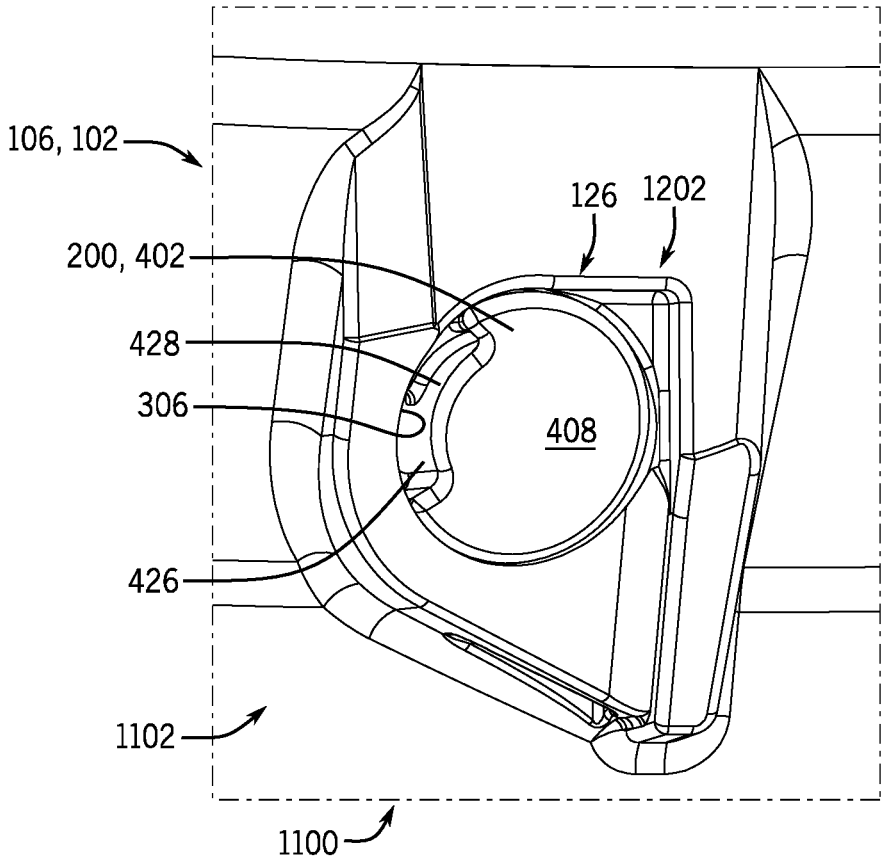
FIGS. 11 and 12 are two cutaway, outwardly-directed perspective views of the food waste disposer and the plug extending through the dishwasher inlet, taken respectively from respective locations within an interior of the food waste disposer, so as to reveal interior surface portions of the food waste disposer that are proximate to and define an inner end of the dishwasher inlet, as well an inner end of the plug when fully installed in the dishwasher inlet.
Figure 12:
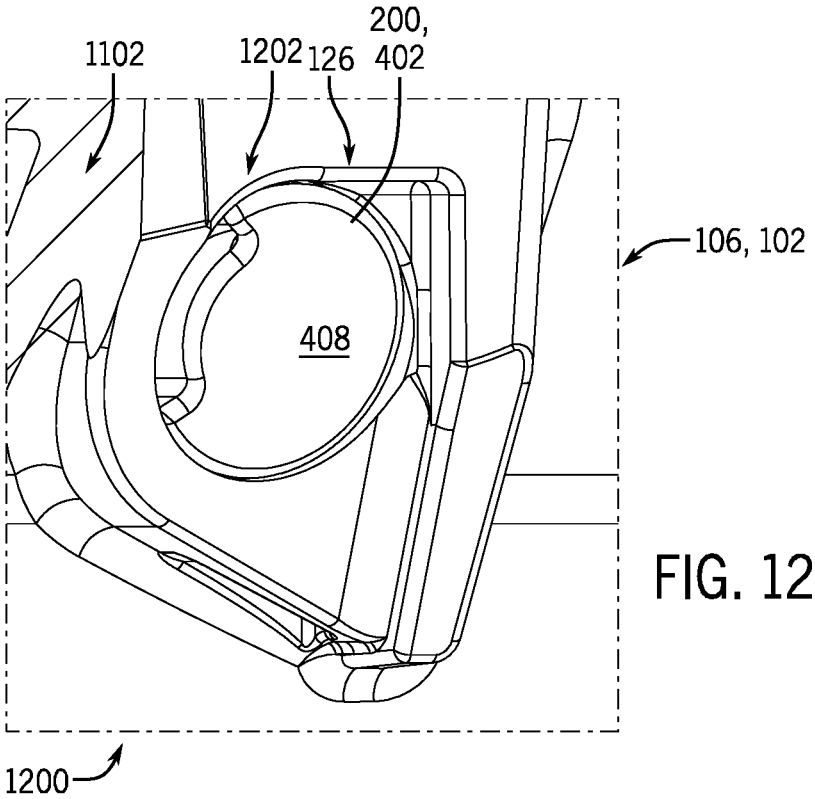

Referring additionally to FIGS. 11 and 12, first and second additional cutaway, outwardly-directed perspective views 1100 and 1200, respectively, of the food waste disposer 102 and the plug 200 extending through the dishwasher inlet 126, taken respectively from respective locations within the interior region 130 of the food waste disposer, are shown. The views 1100 and 1200 reveal interior surface portions 1102 of the food waste disposer 102 (particularly of the enclosure 106) that are proximate to and define an inner end of the dishwasher inlet 126, as well as show the rear end 408 of the plug 200 when the plug is fully installed in the dishwasher inlet (that is, having a position corresponding to that shown in each of FIG. 1, FIG. 2, FIG. 8, FIG. 9, and FIG. 10). Among other things, the views 1100 and 1200 reveal portions of the first and second curving indentations 426 and 428 that create a gap between the main body 402 of the plug 200 and the inner wall 306 of the dishwasher inlet 126. Also as shown, when fully installed, the rear end 408 of the plug 200 is slightly recessed into a raised (inwardly protruding) portion or region (or area) 1202 of the interior surface portions 1102 of the food waste disposer 102. In the present example embodiment, the angle matching is set to be just under flush, so that the plug 200 blends in the block and works with an assembly conveyance system.

It should be apparent from FIGS. 1-12 described above, and particularly from FIGS. 2-10, that in the present embodiment the dishwasher inlet 126 and plug 200 are configured so that the plug can be coupled to the dishwasher inlet 126 so as to be fully installed and coupled to the dishwasher inlet 126—so as to fully close/seal the dishwasher inlet—by a process of inserting the plug into the dishwasher inlet 126 and then rotating the plug 90 degrees (e.g., by a "quarter-turn") in the direction of the arrow 204 of FIG. 2. To begin this installation process, the plug 200 is inserted into the channel 300 as far as possible with the plug being rotated about the central axis 308 so that the outwardly-extending tab 414 is at a location rotated counterclockwise by 90 degrees from the position of the outwardly-extending tab 414 shown in FIG. 2 (e.g., at a location corresponding to the location of the beginning of the arrow 204 shown in FIG. 2). Then, the plug 200 is rotated clockwise 90 degrees in the direction of the arrow 204 to attain the position shown in FIG. 2 and achieve full installation of the plug in the dishwasher inlet 126. Further, if the plug 200 is in the fully installed position as shown in FIG. 2, FIG. 8, and FIG. 10, then the plug 200 can be removed (or deinstalled) by a reverse process in which the plug is rotated counterclockwise 90 degrees (e.g., by a "quarter-turn") away from the position shown in FIG. 2, contrary to the direction of the arrow 204, and then additionally pulled out of the channel 300.

It should additionally be apparent how, during the installation process, particular movements of the plug 200 relative to the dishwasher inlet 126 are governed by contacts/interaction between the first and second internal involute installation lugs 706 and 708 and the first, second, and third barrier walls 430, 432, and 434. More particularly when the plug 200 is first inserted into the channel 300 of the dishwasher inlet 126 with the outwardly-extending tab 414 at the location 90 degrees counterclockwise of the position shown in FIG. 2, it should be appreciated that the first and second internal involute installation lugs 706 and 708 pass along the plug 200 within axial portions 504 (see FIGS. 4 and 5) of the first and second curving indentations 426 and 428, until a forwardly-facing surface 710 (see FIG. 7) of the first internal involute installation lug 706 comes into contact with a rearwardly-facing surface 510 (see FIGS. 4 and 5) of the first barrier wall 430. Then, as the plug 200 is rotated about the central axis 308 (and about the central axis 404) in the clockwise direction of the arrow 204 as shown in FIG. 2, a rearwardly-facing surface 720 of the first internal involute installation lug 706 (see FIG. 8 and FIG. 9) comes into contact with a forwardly-facing ramped (or sloped) surface 520 (see FIG. 5 and FIG. 9) the second barrier wall 432. Also (at least in some circumstances or embodiments), at this time (or at some point during rotation of the plug) a rearwardly facing surface 730 of the second internal involute installation lug 708 (again see FIG. 8 and FIG. 9) comes into contact with a forwardly-facing ramped (or sloped) surface 530 of the third barrier wall 434 (see FIG. 5 and FIG. 9).

Due to this contact between the first internal involute installation lug 706 and the second barrier wall 432, and also (in some circumstances or embodiments) between the second internal involute installation lug 708 and the third barrier wall 434, the clockwise rotation of the plug 200 relative to the dishwasher inlet 126 is accompanied by axial movement of the plug 200 from the outer tip edge 600 further into and through the channel 300, so that overall the plug 200 is effectively screwed into the dishwasher inlet 126. This rotational and axial movement of the plug 200 can continue until the outwardly-extending tab 414 encounters and abuts the rib 604, which occurs at the same time as the first internal involute installation lug 706 encounters the first end wall portion 436 of the first curving indentation 426, and as the second internal involute installation lug 708 encounters the second end wall portion 438 of the second curving indentation 428. At this time, the first internal involute installation lug 706 becomes wedged or substantially wedged between a rearwardly-facing surface 740 of the first barrier wall 430 (which is an extension of the rearwardly-facing surface 510 shown in FIG. 5) and a forwardly-facing surface 750 of the second barrier wall 432 (which is an extension of the forwardly-facing surface 520, see FIGS. 5, 8, and 9). Also at this time, the second internal involute installation lug 708 becomes wedged (or substantially wedged) between a rearwardly-facing surface 760 of the second barrier wall 432 and a forwardly-facing surface 770 of the third barrier wall 434 (which is an extension of the forwardly-facing ramped surface 530, see FIGS. 5, 8, and 9). Accordingly, the first and second internal involute installation lugs 706 and 708 are respectively interlocked between the first and second barrier walls 430 and 432 and between the second and third barrier walls 432 and 434, respectively, such that the plug 200 is axially secured (e.g., along the central axis 308) in position relative to the dishwasher inlet 126.

Likewise, during the removal (or deinstallation process), particular movements of the plug 200 relative to the dishwasher inlet 126 again are governed by contacts/interaction between the first and second internal involute installation lugs 706 and 708 and the first, second, and third barrier walls 430, 432, and 434. More particularly, starting at a circumstance when the plug 200 is in its fully installed position as shown in FIG. 2, FIG. 8, and FIG. 9, removal proceeds when a user causes the plug to be rotated in the direction opposite the direction indicated by the arrow 204 in FIG. 2. As this occurs, the forwardly-facing surface 710 (see FIG. 7) of the first internal involute installation lug 706 slides along the rearwardly-facing surfaces 740 and 510 (see FIGS. 4, 5, 7, and 8) of the first barrier wall 430, which tends to unscrew the plug 200 from the dishwasher inlet 126 and force the plug 200 axially outward out of the channel 300 past the outer tip edge 600. Although not the case in the present embodiment, in some embodiments, the rearwardly-facing surface 760 of the second barrier wall 432 can also interface a forwardly-facing surface of the second internal involute installation lug 708 so as to also contribute to the unscrewing of the plug 200 from the dishwasher inlet 126. When the plug 200 is rotated sufficiently so that the first and second internal involute installation lugs 706 and 708 enter the axial portions 504 (see FIGS. 4 and 5) of the first and second curving indentations 426 and 428, then the plug can be fully axially removed from the channel 300 and the dishwasher inlet 126.

In addition to the above-described aspects of processes for installing and removing the plug 200 relative to the dishwasher inlet 126, several other aspect of these processes should also be evident from FIGS. 1 through 12 (and particularly FIGS. 2 through 10). First, the forces/torques for installing and remove the plug 200 can be applied by a user, at least in some embodiments such as the present embodiment, by inserting a hex wrench (not shown) into the hex key orifice 442 and applying the appropriate forces and/or torques (e.g., torques in the direction of the arrow 204 of FIG. 2 for installation or contrary to the direction of the arrow 204 for removal). Second, it should be appreciated from FIG. 8 that, when the plug 200 is fully installed with respect to (e.g., screwed into) the dishwasher inlet 126, the O-ring 410 is positioned fully within the channel 300 and extends fully around the circumference of the plug 200 and thus forms a seal (e.g., a watertight or fluid-resistant seal) along an entire circumferential junction between the plug and the inner wall 306 of the dishwasher inlet.

Further, it should be appreciated from FIG. 2, FIG. 8, and FIG. 10 that installation of the plug 200 corresponding to rotation in the direction of the arrow 204 causes the tip portion 440 of the locking spring extension 422 to proceed from a first region 1006 counterclockwise of a first sloped surface 1008 of the locking block 704 to a locking location 1010 that is just clockwise of, and adjacent to, a second sloped surface 1012 of that locking block (see particularly FIG. 10 for the first region, locking location, and first and second sloped surfaces). The tip portion 440 of the locking spring extension 422 is able to proceed from the first region 1006 to the locking location 1010, past the locking block 704, due to the locking spring extension having flexibility allowing for that the tip portion to be pushed radially inwardly when it is passing by the locking block.

Because of the shape and positioning of the locking spring extension 422 (including the tip portion 440) and the locking block 704, and the relative positioning of the outwardly-extending tab 414 and rib 604, the tip portion 440 attains the locking location 1010 just as the outwardly-extending tab comes into contact with the rib 604. Consequently, when the tip portion 440 reaches the locking location 1010, the plug 200 becomes rotationally locked in place due to the clockwise force applied by the second sloped surface 1012 upon the tip portion 440 and the clockwise force applied by the rib 604 upon the outwardly-extending tab 414. Further, so long as the plug is rotationally in this position, the plug not only is retained rotationally in position but also retained axially in position relative to the dishwasher inlet 126, given the interlocking barrier walls 430, 432, and 434 and first and second internal involute installation lugs 706 and 708 as shown in FIG. 8 and FIG. 9.

Thus, when the plug 200 is installed relative the dishwasher inlet 126 by axially inserting and then rotating in the plug in the clockwise direction of the arrow 204 as shown in FIG. 2, the interaction of the locking spring extension 422 with the locking block 704 results in the plug being rotationally locked in place when the tip portion 440 attains the locking location 1010 shown in FIG. 10. However, notwithstanding such rotational locking when the plug 200 is fully installed, the plug can still be removed if sufficient force (or torque) is applied to the plug. That is, even though the positioning of the locking block 704 against the locking spring extension 422 tends to counteract any rotational movement of the plug 200 in a counterclockwise direction as represented by the arrow 1004 when the plug is in the fully installed position as shown in FIG. 10, the plug 200 can still be rotated in the counterclockwise direction so that the tip portion 440 first moves radially inward and then moves counterclockwise past the locking block if sufficient force/torque is applied in the direction of the arrow 1004. Accordingly, when the plug 200 is fully installed in the dishwasher inlet 126 but removal of the plug from the dishwasher inlet is desired, then the locking of the locking spring extension 422 relative to the locking block 704 can be overcome by the application of torque in the direction of the arrow 1004 of FIG. 10 and, when the plug has been sufficiently rotated (e.g., 90 degrees) in that direction, the plug can be fully axially removed from the dishwasher inlet 126.

Notwithstanding the above description, the present disclosure is intended to encompass numerous embodiments having other or additional features differing from or in addition to those described herein. For example, although the embodiment shown in FIGS. 2 through 10 entails a plug that is fully installed in relation to a dishwasher inlet by inserting the plug and rotating the plug 90 degrees or substantially 90 degrees (e.g., a "quarter-turn") in a first rotational direction, and is removed (after being fully installed) by rotating the plug 90 degrees or substantially 90 degrees in the opposite rotational direction, in other embodiments encompassed herein a plug can be inserted or removed relative to a dishwasher inlet by rotations involving substantially more than (e.g., 120 degrees) or less than (e.g., 60 degrees) 90 degrees. Also for example, although the embodiment shown in FIGS. 2 through 10 entails a dishwasher inlet 126 having the first and second internal involute installation lugs 706 and 708 and having the first and second curving indentations 426 and 428, in other embodiments there can be fewer or more than two lugs and/or fewer or more than two of the curving indentations.

Additionally for example, although the embodiment of FIGS. 2 through 10 entails the locking spring extension 422 and locking block 704, in other embodiments more than one locking spring extension and more than one of the locking blocks can be present. Further for example, although the present embodiment includes the O-ring 410, in other embodiments more than one O-ring or other sealing structure may be present.

Also for example, although embodiments described above envision that one or more protrusions such as the first and second internal involute lugs 706 and 708 are formed as part of an inner wall of the dishwasher inlet (or other port) and protrude inwardly, and that the plug includes one or more curving indentations or other receiving formations into which those protrusions are received when the plug is installed in relation to the dishwasher inlet, the present disclosure also encompasses embodiments having other arrangements of protrusions and receiving formations. For example, the present disclosure also encompasses embodiments in which the plug includes one or more protrusions along its external surface that can extend outward from the plug, and in which the inner wall of the dishwasher inlet (or other port) includes indentations or other receiving formations into which those protrusions are received when the plug is installed in relation to the dishwasher inlet. Indeed, the present disclosure is intended to encompass any of a variety of embodiments in which various protrusion, receiving formations, or other interfacing features (e.g., complementary features) formed on the dishwasher inlet (or other port) and plug are provided to facilitate desired interrelated movement of the plug relative to the dishwasher inlet.

Further, notwithstanding the particular configuration of the dishwasher inlet described above (e.g., as including a cylindrical structure extending away from a wall portion), the present disclosure encompassed numerous other arrangements or configurations of dishwasher inlets, or other inlets, outlets, or ports. For example, in some alternate embodiments encompassed herein, the port that can be closed, sealed, or plugged by a plug can merely be an orifice formed within a wall portion and not include any cylindrical portion that extends away from a wall portion. Also, the present disclosure encompasses embodiments that relate not only to food waste disposers but also to any of a variety of other types of waste disposers. Further, the present disclosure encompasses embodiments in which a plug or other sealing or closing component is employed to close, seal, or plug any of a variety of types of inlets, outlets, or other ports, whether such ports serve as dishwasher inlets or in other capacities.

Depending upon the embodiment, one or more of the embodiments encompassed herein can have or achieve one or more advantages. For example, at least some embodiments encompassed herein involve plugs and dishwasher inlets in which the plug can be installed/inserted, removed/deinstalled, and reinstalled/reinserted easily and repeatedly (at multiple times) without losing effectiveness (e.g., without the plug breaking during removal). Further for example, such embodiments can be easier to install, remove, and reinstall than some conventional embodiments in which a plug for a dishwasher inlet is held in place by way of an external snap arm. Also, at least some embodiments encompassed herein have two retention features (e.g., the first and second internal involute installation lugs 706 and 708) for robustness, and which also can contribute to the effectiveness of the plug in preventing the leakage of fluids through (e.g., out of) the dishwasher inlet. Additionally, at least some embodiments encompassed herein enable installation or removal/deinstallation of a plug relative to a dishwasher inlet by way of only a small amount of rotation (e.g., 90 degrees, or a "quarter-turn"), and installation or removal/deinstallation can be achieved by way of less user-applied force that in some conventional implementations in which plugs are implemented in regard to dishwasher inlets.

Further, at least some embodiments encompassed herein employ a locking spring, which counteracts rotation of the plug away from a fully installed rotational position (e.g., due to positioning of the tip portion 440 of the locking spring extension against the locking block 704) and thereby maintains the plug in place axially insofar as axial removal can only be achieved when the plug is in a different rotational position. Also, at least some embodiments encompassed herein have a hex key orifice that utilizes the same internal hex size as an anti-jam wrench that is already included with the waste disposer (e.g., as a standard component). Additionally, at least some embodiments encompassed herein employ a plug having an outwardly-extending tab that helps determine when the plug is fully installed. Such an arrangement particularly helps avoid damage to the plug that might occur due to overtightening insofar as the tab, in combination with a rib formed on the dishwash inlet, serves as a stop in regard to rotation of the plug relative to the dishwasher inlet (e.g., the rib 604 forms a stop against which the outwardly-extending tab 414 rests). Further, at least some such embodiments having a plug with an outwardly-extending tab also are advantageous in that the plug with the tab makes it more difficult for a user to connect/hook up a dishwasher inlet hose to the dishwasher inlet of the waste disposer when the plug is installed. Also, at least some embodiments encompassed herein include an O-ring to achieve sealing/prevent leakage that has a reduced cross section and is positioned away from detent grooves that can be formed on the plug.

The present disclosure is also intended to encompass additional embodiments in which a dishwasher inlet or other auxiliary port (or other port) having features that are identical or substantially similar to those of the dishwasher inlet 126—at least in terms of the features of the port that allow for the port to be closed or sealed (or plugged) by a plug that is identical or substantially similar to the plug 200—is formed on a different device or structure other than a waste disposer. Such additional embodiments can be understood to include the different device or structure on which the auxiliary port (or other port) is formed, plus the plug that is identical to or substantially similar to the plug 200. Also, in some such embodiments, the different device or structure can be entirely independent of, and not serve any purpose related to that of, any waste disposer such as a food waste disposer. Further, in some other embodiments, the different device or structure can be an auxiliary device that interfaces with or is coupled to a waste disposer such as the food waste disposer 102. Additionally, in some alternate embodiments, such a different device or structure can include not only one but rather more than one port having features that are identical or substantially similar to those of the dishwasher inlet 126—at least in terms of the features of each port that allow for each port to be closed or sealed (or plugged) by a plug that is identical or substantially similar to the plug 200. Such alternate embodiments can also include more than one plug that is identical or substantially similar to the plug 200.

Further for example in this regard, FIG. 1 additionally shows an auxiliary device 140 that includes both an auxiliary device input port 142 and an auxiliary device output port 144, where a plug 146 that is identical or substantially similar to the plug 200 (e.g., in terms of having an outwardly-extending tab 148 that is identical to the outwardly-extending tab 414 and barrier walls corresponding to two or more of the barrier walls 430, 432, and 434 described above) is shown to be positioned within the auxiliary device input port 142. The auxiliary device 140 and plug 146 are shown by phantom lines, insofar as these structures are considered an optional part of the combination system 100.

More particularly, in this example embodiment including the auxiliary device 140, the auxiliary device output port 144 can be formed in a manner that is complementary to the dishwasher inlet 126 so that (as with the distal end 138 of the hose 134) the auxiliary device output port can be coupled to the dishwasher inlet 126 (e.g., with the plug 200 removed from the dishwasher inlet). Further, the auxiliary device input port 142 can be structurally identical to the dishwasher inlet 126, especially in terms of the features that are configured to interface with the plug 146 (e.g., the channel 300 and first and second internal involute installation lugs 706 and 708) as well as the features that allow for another structure such as the hose 134 to be coupled to the auxiliary device input port. Thus, although FIG. 1 illustrates the auxiliary device 140 as being disassembled from the food waste disposer 102 and the hose 134 of the dishwasher 104, it should be appreciated not only that the auxiliary device output port 144 can be coupled to the dishwasher inlet 126 (with the plug 200 being removed from that dishwasher inlet), but also that the distal end of 138 of the hose 134 can be coupled to the auxiliary device input port 142 (with the plug 146 being removed from the auxiliary device input port). Alternatively, the auxiliary device output port 144 can be coupled to the dishwasher inlet 126 of the food waste disposer 102, but the auxiliary device input port 142 can be left disassembled from the hose 134, with the plug 146 being positioned in relation to the auxiliary device input port as illustrated, so as to prevent flow from the interior of the auxiliary device 140 out through the auxiliary device input port 142. Notwithstanding this description of the auxiliary device 140 of FIG. 1 as an optional example of a device or structure (other than a waste disposer) that has a port and a plug capable of sealing or closing that port, it should be appreciated that the present disclosure also encompasses numerous other variations and embodiments of devices and structures in addition to this example.

It is specifically intended that the present invention not be limited to the embodiments and illustrations contained herein, but include modified forms of those embodiments including portions of the embodiments and combinations of elements of different embodiments as come within the scope of the following claims.

We claim:

1. A food waste disposer comprising:

a food conveying section, a motor section, and a grinding section between the food conveying section and the motor section;

a housing having a dishwasher inlet, wherein each of the food conveying section, the motor section, and the grinding section, are positioned inside the housing, wherein the dishwasher inlet includes a substantially cylindrical inner wall, the inner wall defines a channel extending from a first location along an exterior of the housing and a second location along an interior of the housing, and wherein the inner wall includes a first protrusion that extends radially inwardly toward a central axis of the channel; and a plug having a first end and a second end, wherein the plug is substantially cylindrical in shape, and includes an exterior surface having a first barrier wall portion and a second barrier wall portion, wherein the first barrier wall portion and the second barrier wall portion together at least partly define a first curving indentation, wherein the first curving indentation extends substantially axially from the second end toward the first end and wherein the first curving indentation extends circumferentially substantially ninety degrees between the second end and a first internal end of the first curving indentation, and wherein the dishwasher inlet and plug are configured so that, when the plug is supported within the dishwasher inlet in a fully installed position in which the first protrusion extends into the first curving indentation so as to be in contact with or proximate to the first internal end, then the plug is retained axially relative to the dishwasher inlet along the central axis at least in part by contact between the first protrusion and one or both of the first barrier wall portion and the second barrier wall portion.

2. The food waste disposer of claim 1, wherein the dishwasher inlet and the plug are further configured so that, when the plug is rotated substantially ninety degrees away from the fully installed position in a first rotational direction, then the plug is removable from the dishwasher inlet.

3. The food waste disposer of claim 2, wherein the plug further includes a spring extension including a tip portion, wherein the dishwasher inlet includes a block portion extending radially inwardly from the inner wall, and where the tip portion engages the block portion when the plug is supported within the dishwasher inlet in the fully installed position so that there is resistance to the plug being rotated in the first rotational direction.

4. The food waste disposer of claim 3 wherein, in response to a torque being applied to the plug, the spring extension is compressed so that the tip portion passes by the block portion when the plug is rotated away from the fully installed position in the first rotational direction.

5. The food waste disposer of claim 1, wherein the plug further includes an outwardly-extending tab at the first end, wherein the dishwasher inlet includes a substantially cylindrical portion extending outward from a wall portion of the housing, wherein the substantially cylindrical portion includes at the first location an outer rim, wherein the outer rim includes a discontinuity in the form of a radially-extending rib, and wherein, when the plug is in the fully installed position, the outwardly-extending tab is positioned adjacent to the radially-extending rib, and wherein the radially-extending rib serves to prevent a rotation of the plug in a second rotational direction opposite the first rotational direction.

6. The food waste disposer of claim 1, further comprising an O-ring extending circumferentially around the plug between the first and second ends, wherein the O-ring when in an uncompressed state has an outer diameter that is greater than a channel diameter of the channel so that, when the plug is in the fully installed position, a seal that extends fully around a circumference of the plug is formed along a junction between the O-ring and the inner wall.

7. The food waste disposer of claim 1, wherein the inner wall of the dishwasher inlet includes a second protrusion that extends radially inwardly toward the central axis of the channel, the second protrusion being closer to the second location than the first protrusion, wherein the exterior surface of the plug has a third barrier wall portion, wherein the second barrier wall portion and the third barrier wall portion together at least partly define a second curving indentation, wherein the second curving indentation extends substantially axially from the second end toward the first end, and wherein the second curving indentation extends circumferentially substantially ninety degrees between the second end and a second internal end of the first curving indentation, the second internal end being closer to the second end than the first internal end, and wherein the dishwasher inlet and plug are configured so that, when the plug is supported within the dishwasher inlet in the fully installed position, the second protrusion extends into the second curving indentation so as to be in contact with or proximate to the second internal end.

8. The food waste disposer of claim 1, wherein the first curving indentation is substantially helical, and wherein when the plug is in the fully installed position, the second end of the plug is recessed relative to the second location along the interior of the housing.

9. The food waste disposer of claim 1, further comprising an hex key orifice formed along the first end and configured to receive a complementary wrench by which a torque is applied to the plug.

10. A combination system including the food waste disposer of claim 1 and a dishwasher.

11. A waste disposer comprising:

a housing including an inlet port, an outlet port, and an auxiliary port, wherein the auxiliary port includes a substantially cylindrical inner wall, the inner wall defines a channel extending from a first location along an exterior of the housing and a second location along an interior of the housing, and wherein the inner wall includes a first protrusion that extends radially inwardly toward a central axis of the channel; and a plug having a first end and a second end, wherein the plug is substantially cylindrical in shape, and includes an exterior surface having a first barrier wall portion and a second barrier wall portion, wherein the first barrier wall portion and the second barrier wall portion together at least partly define a first curving indentation, wherein the first curving indentation extends substantially axially from the second end toward the first end and wherein the first curving indentation extends circumferentially substantially ninety degrees between the second end and a first internal end of the first curving indentation, and wherein the plug further includes a spring extension including a tip portion, wherein the auxiliary port and plug are configured so that, when the plug is supported within the auxiliary port in a fully installed position in which the first protrusion extends into the first curving indentation so as to be in contact with or proximate to the first internal end, then the plug is retained axially relative to the auxiliary port along the first central axis at least in part by contact between the first protrusion and one or both of the first barrier wall portion and the second barrier wall portion, and wherein the auxiliary port includes a block portion extending radially inwardly from the inner wall, wherein the tip portion engages the block portion when the plug is supported within the auxiliary port in the fully installed position so that there is resistance to the plug being rotated in a first rotational direction.

12. The waste disposer of claim 11, wherein the auxiliary port and the plug are configured so that, when the plug is rotated substantially ninety degrees away from the fully installed position in a first rotational direction, then the plug is removable from the auxiliary port.

13. The waste disposer of claim 11 wherein, in response to a torque being applied to the plug, the spring extension is compressed so that the tip portion passes by the block portion when the plug is rotated away from the fully installed position in the first rotational direction.

14. The waste disposer of claim 11, wherein the plug further includes an outwardly-extending tab at the first end, wherein the auxiliary port includes a substantially cylindrical portion extending outward from a wall portion of the housing, wherein the substantially cylindrical portion includes at the first location an outer rim, wherein the outer rim includes a discontinuity in the form of a radially-extending rib, and wherein, when the plug is in the fully installed position, the outwardly-extending tab is positioned adjacent to the radially-extending rib, and wherein the radially-extending rib serves to prevent a rotation of the plug in a second rotational direction opposite the first rotational direction.

15. The waste disposer of claim 11, further comprising an O-ring extending circumferentially around the plug between the first and second ends, wherein the O-ring when in an uncompressed state has an outer diameter that is greater than a channel diameter of the channel so that, when the plug is in the fully installed position, a seal that extends fully around a circumference of the plug is formed along a junction between the O-ring and the inner wall.

16. The waste disposer of claim 11, wherein the inner wall of the auxiliary port includes a second protrusion that extends radially inwardly toward the central axis of the channel, the second protrusion being closer to the second location than the first protrusion, wherein the exterior surface of the plug has a third barrier wall portion, wherein the second barrier wall portion and the third barrier wall portion together at least partly define a second curving indentation, wherein the second curving indentation extends substantially axially from the second end toward the first end, and wherein the second curving indentation extends circumferentially substantially ninety degrees between the second end and a second internal end of the first curving indentation, the second internal end being closer to the second end than the first internal end, and wherein the auxiliary port and plug are configured so that, when the plug is supported within the auxiliary port in the fully installed position, the second protrusion extends into the second curving indentation so as to be in contact with or proximate to the second internal end.

17. A method of operating a dishwasher inlet of a food waste disposer having a food conveying section, a motor section, and a grinding section between the food conveying section and the motor section and a housing having a dishwasher inlet, wherein each of the food conveying section, the motor section, and the grinding section, are positioned inside the housing, the method comprising:

providing a plug having a first end and a second end, wherein the plug is substantially cylindrical in shape, and includes an exterior surface having a first barrier wall portion and a second barrier wall portion, wherein the first barrier wall portion and the second barrier wall portion together at least partly define a first curving indentation, wherein the first curving indentation extends substantially axially from the second end toward the first end and wherein the first curving indentation extends circumferentially substantially ninety degrees between the second end and a first internal end of the first curving indentation;

inserting the plug into a channel defined by a substantially cylindrical inner wall of the dishwasher inlet, wherein the inner wall includes a first protrusion extending radially inwardly toward a central axis of the channel, and wherein the plug is inserted substantially axially along the central axis of the channel so that the second end of the plug proceeds from a first location along an exterior of the housing toward a second location along an interior of the housing, and rotating the plug by substantially ninety degrees in a first rotational direction as the plug is further inserted into the channel, the rotating occurring at least in part when the first protrusion of the inner wall proceeds into and through the first curving indentation until the first protrusion contacts or becomes proximate to the first internal end as the plug is further inserted into the channel, whereby the plug attains a fully installed position relative to the dishwasher inlet in which the plug is retained axially relative to the dishwasher inlet along the central axis at least in part by contact between the first protrusion and one or both of the first barrier wall portion and the second barrier wall portion.

18. The method of claim 17, further comprising:

retaining the plug rotationally in the fully installed position by a tip portion of a locking spring of the plug engaging a block portion extending radially-inwardly from the inner wall, and providing sealing of the dishwasher inlet by the plug when the plug is in the fully installed position, at least in part by an O-ring positioned circumferentially around the plug to be in contact with the inner wall.

19. The method of claim 17, further comprising removing the plug from the dishwasher inlet by rotating the plug relative to the dishwasher inlet by substantially ninety degrees in a second rotational direction and retracting the plug axially out of the channel.

20. The method of claim 19, further comprising reinstalling the plug into the channel after the plug has been removed.

* * * * *